US010845151B2

(12) United States Patent
Pellegri

(10) Patent No.: US 10,845,151 B2
(45) Date of Patent: Nov. 24, 2020

(54) TURRET HAVING A MUNITION GUIDANCE DEVICE PROTECTION

(71) Applicant: LEONARDO S.P.A., Rome (IT)

(72) Inventor: Mauro Pellegri, Villafranca Lunigiana (IT)

(73) Assignee: LEONARDO S.P.A., Rome (IT)

( * ) Notice: Subject to any disclaimer, the term of this patent is extended or adjusted under 35 U.S.C. 154(b) by 0 days.

(21) Appl. No.: 15/775,495

(22) PCT Filed: Nov. 8, 2016

(86) PCT No.: PCT/IB2016/056704
§ 371 (c)(1),
(2) Date: May 11, 2018

(87) PCT Pub. No.: WO2017/081599
PCT Pub. Date: May 18, 2017

(65) Prior Publication Data

US 2018/0372439 A1 Dec. 27, 2018

(30) Foreign Application Priority Data

Nov. 13, 2015 (IT) ..... 102015000072556

(51) Int. Cl.
*F41A 23/24* (2006.01)
*F41H 5/16* (2006.01)
(Continued)

(52) U.S. Cl.
CPC ..... *F41A 23/24* (2013.01); *F41A 23/20* (2013.01); *F41H 5/16* (2013.01); *F41H 5/20* (2013.01); *F41H 7/04* (2013.01)

(58) Field of Classification Search
CPC .. F41A 23/24; F41A 23/20; F41H 5/16; F41H 5/20
(Continued)

(56) References Cited

U.S. PATENT DOCUMENTS 3,800,659 A * 4/1974 Kuiper ..... F41A 23/20 89/40.03
4,054,080 A * 10/1977 Rossel ..... F41A 23/20 89/38
(Continued)

FOREIGN PATENT DOCUMENTS

DE 977774 C 1/1970
DE 102009020161 A1 11/2010
WO 2013/050834 A1 4/2013

OTHER PUBLICATIONS

Internatioanl Search Report and Written Opinion from International Application No. PCT/IB2016/056704, dated Feb. 14, 2017.

*Primary Examiner* — Michelle Clement
(74) *Attorney, Agent, or Firm* — Merchant & Gould P.C.

(57) ABSTRACT

A turret includes a firearm, which is configured to shoot munitions. A support assembly supports the firearm and is configured to move the firearm about an azimuthal rotation or swiveling axis (Y) and about a zenithal rotation or elevation axis (X). A munition guidance device mounts on the support assembly and is configured to direct a precision-guided munition, which is shot by the firearm towards a target. A protection apparatus is mounted on the support assembly and is configured to assume: a covering condition, in which the protection apparatus hides the munition guidance device on the inside of the support assembly; and an opening condition, in which the protection apparatus exposes the munition guidance device on the outside of the support assembly.

12 Claims, 3 Drawing Sheets

(51) Int. Cl.
*F41H 5/20* (2006.01)
*F41A 23/20* (2006.01)
*F41H 7/04* (2006.01)

(58) Field of Classification Search
USPC ..... 89/36.13
See application file for complete search history.

(56) References Cited

U.S. PATENT DOCUMENTS 4,144,797 A * 3/1979 Berge ..... F41A 27/18 89/36.13
4,386,848 A * 6/1983 Clendenin ..... F41G 3/165 356/5.01
4,388,854 A * 6/1983 Dabrowski ..... F41A 9/16 89/34
4,489,639 A * 12/1984 Winkler ..... F41A 9/16 89/36.13
4,667,565 A * 5/1987 Anderson ..... F41A 23/20 89/36.08
4,708,052 A * 11/1987 Argon ..... F41A 23/20 89/38
4,771,673 A * 9/1988 Miller ..... F41H 5/26 49/386
6,907,812 B1 * 6/2005 Eckstedt ..... F41A 23/20 89/1.8
8,065,948 B1 * 11/2011 Baptista ..... F41A 23/24 89/36.14
8,438,964 B1 * 5/2013 Nolte ..... F41H 5/26 89/36.04
9,086,255 B1 * 7/2015 Berman ..... F41H 5/20
2004/0069135 A1 * 4/2004 Fowler ..... F41A 9/10 89/1.805
2005/0066806 A1 * 3/2005 Helms ..... F41A 23/20 89/38
2007/0204745 A1 * 9/2007 Son ..... F41A 17/06 89/27.3
2008/0047421 A1 * 2/2008 Carroll, III ..... F41A 23/12 89/38
2008/0110326 A1 * 5/2008 Sbrighi ..... B63G 1/00 89/41.01
2008/0202326 A1 * 8/2008 Carroll ..... F41A 23/12 89/38
2008/0216727 A1 * 9/2008 Philippe ..... B63B 1/06 114/15
2010/0126338 A1 * 5/2010 Rastegar ..... F41A 27/26 89/37.13
2012/0024143 A1 * 2/2012 Shacklee ..... F41A 23/24 89/41.02
2012/0180641 A1 * 7/2012 Chiappini Andrea .... F41A 9/82 89/36.13
2012/0247317 A1 * 10/2012 Karakookly ..... F41A 23/24 89/127
2013/0145925 A1 * 6/2013 Lorenz ..... F41A 23/24 89/36.13
2014/0116234 A1 * 5/2014 Jacq ..... F41A 23/20 89/1.11
2014/0150637 A1 * 6/2014 Chiappini ..... B63G 1/00 89/36.13
2014/0174283 A1 * 6/2014 Kempas ..... F41A 23/20 89/1.815
2014/0224104 A1 * 8/2014 Kempas ..... F41F 3/042 89/1.815
2015/0082977 A1 * 3/2015 Tikochinski ..... F42B 5/145 89/41.01
2019/0145739 A1 * 5/2019 Jiang ..... F41G 5/06 89/41.05

* cited by examiner

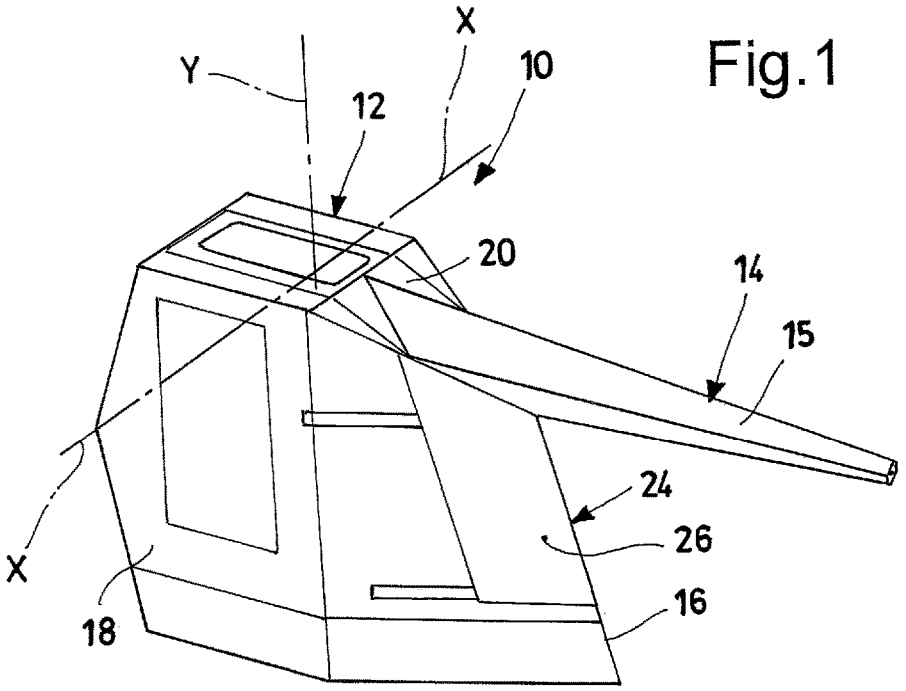
Fig.1
Fig.2
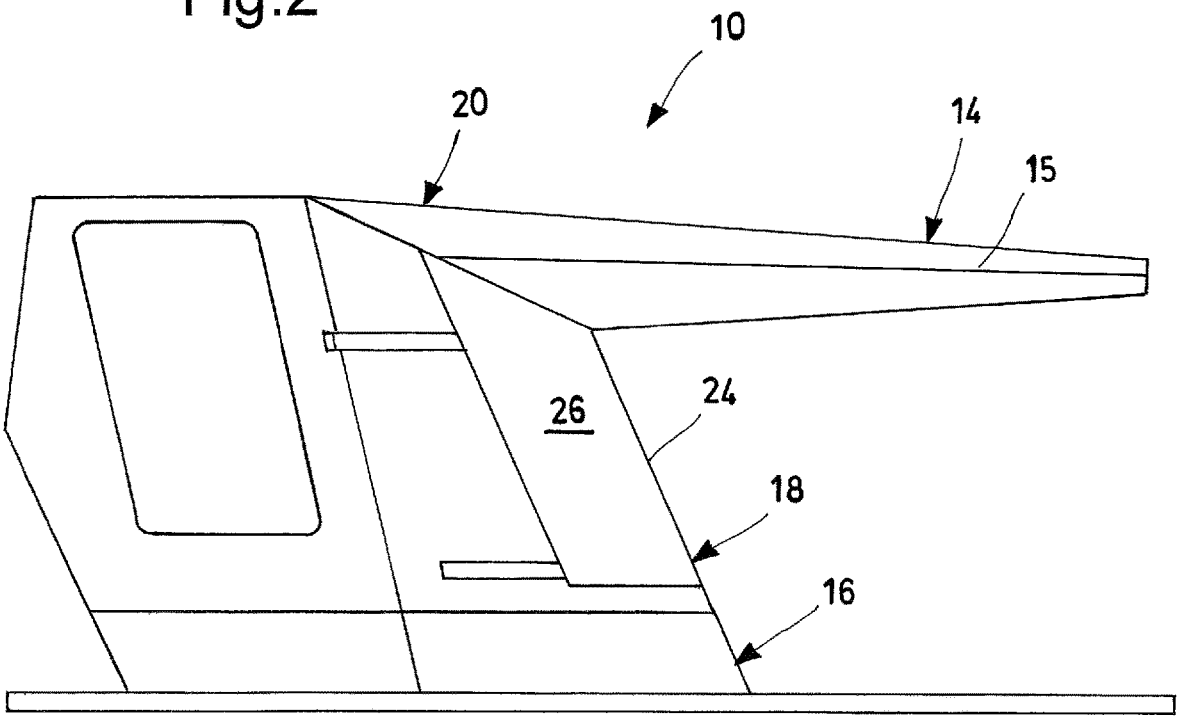

TURRET HAVING A MUNITION GUIDANCE DEVICE PROTECTION

This application is a National Stage Application of International Application no. PCT/IB2016/056704, filed 8 Nov. 2016, which claims benefit of Serial No. 102015000072556, filed 13 Nov. 2015 in Italy and which applications are incorporated herein by reference. To the extent appropriate, a claim of priority is made to each of the above-disclosed applications.

TECHNICAL FIELD

The present invention relates to a turret.

TECHNOLOGICAL BACKGROUND

In this technical field turret assemblies are known, which consist of a device that, on the one hand, protects the crew and/or a mechanism for operating a firearm and, on the other had, allows the crew to orient the firearm so that it can shoot in different shooting directions.

In particular, a turret is moved with a usually rotary movement, in which, for example, the movement is obtained with a combination of a swivelling rotation (namely, about a substantially vertical azimuthal axis) and an elevation rotation (namely, about a substantially horizontal zenithal axis). More specifically, using technical terms, the groups of components making up the turret are commonly divided into the so-called "swivelling mass" and the so-called "pivoting mass". The components making up the "swivelling mass" are substantially arranged at the base of the turret and fixed to a support structure. On the other hand, the components making up the so-called "pivoting mass" are generally supported in a rotary manner by the ones making up the so-called "swivelling mass".

SUMMARY OF THE INVENTION

The object of the present invention is to provide a turret, which is improved compared to the ones manufactured according to the prior art and, at the same time, can be produced in a simple and economic fashion.

According to the invention, this and other objects are reached by a turret.

Further features and advantages of the present invention will be best understood upon perusal of the following detailed description, which is provided by way of example and is not limiting, with reference, in particular, to the accompanying drawings, which are briefly described below.

BRIEF DESCRIPTION OF THE DRAWINGS

FIG. 1 is a perspective view from the top showing a turret according to an explanatory embodiment of the present invention.

FIG. 2 is a lateral elevation view of the turret shown in FIG. 1.

DETAILED DESCRIPTION OF THE INVENTION

Figure 4:
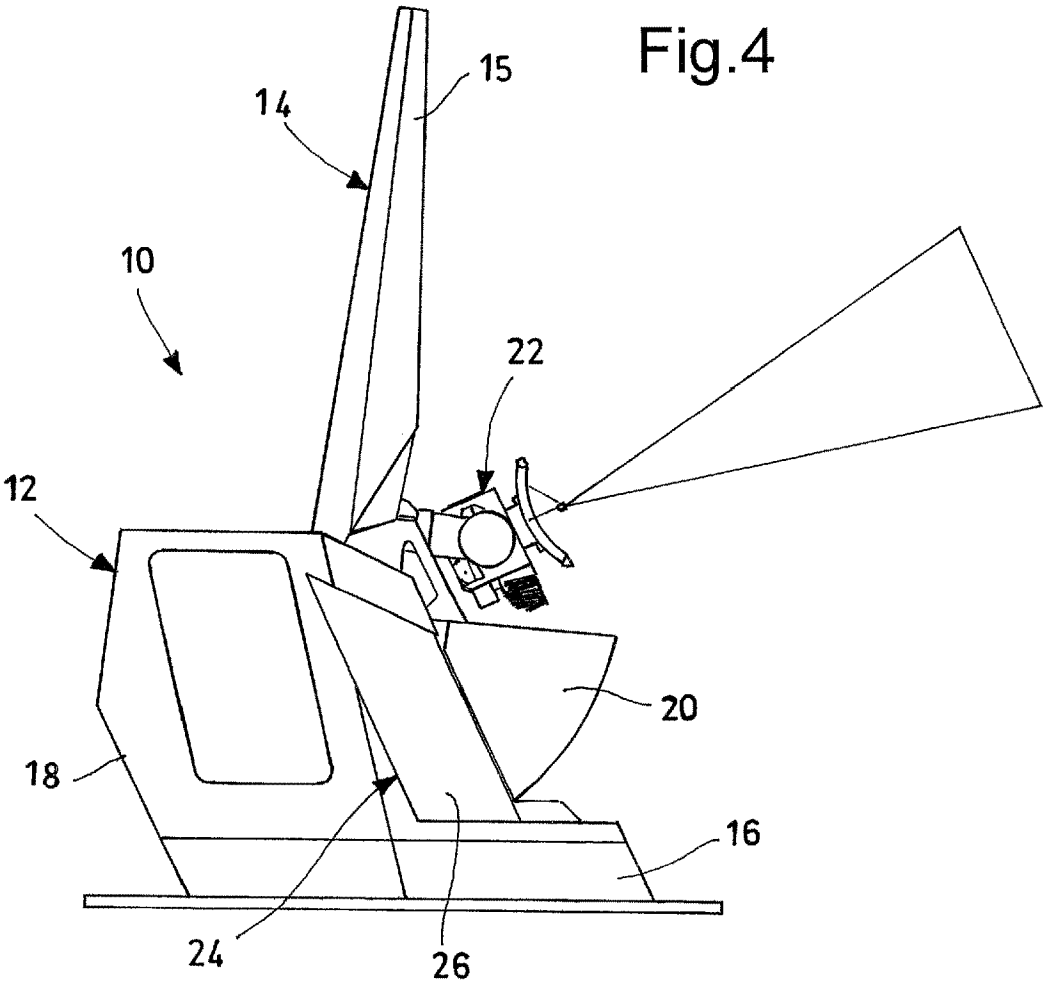
FIG. 4 is a lateral elevation view of the turret, which is similar to the one of FIG. 2, but wherein the turret is in a different operating condition.

With reference to the accompanying figures, number 10 indicates, as a whole, a turret manufactured according to an explanatory embodiment of the present invention.

With particular reference to FIGS. 1 and 2, the turret 10 comprises a support assembly 12, which is configured to support and move a firearm 14 about an azimuthal rotation or swivelling axis Y (which is substantially vertical) and about a zenithal rotation or elevation axis X (which is substantially horizontal). These axes are schematically shown in FIG. 1.

In particular, the support assembly 12 has an outer shape known as "stealth", which permits a reduction of the reflection of electromagnetic waves, so as to reduce the radar track of the turret.

In the embodiment shown herein, the firearm 14 is configured to shoot guided munitions. Said firearm 14 preferably has a "stealth" cover 15, which externally surrounds its barrel and has a shape that permits a reduction of the reflection of electromagnetic waves, so as to further reduce the radar track of the turret.

The support assembly 12 comprises a base 16, which is configured to be fixed to a fixed part (e.g. the upper deck of a ship, by means of a suitable interface), a swivelling mass or structure 18, which is supported by the base 16 in its rotation about the swivelling axis Y, and a pivoting mass or structure 20, which is supported by the swivelling structure in its rotation about the elevation axis X.

In the embodiment shown herein, the firearm 14 is mounted so as to be integral to the pivoting structure 20 in its movements, so that it is capable of simultaneously being integral to the swivelling structure 18 in its rotation about the swivelling axis Y and integral to the pivoting structure 20 in its rotation about the elevation axis X.

Figure 3:
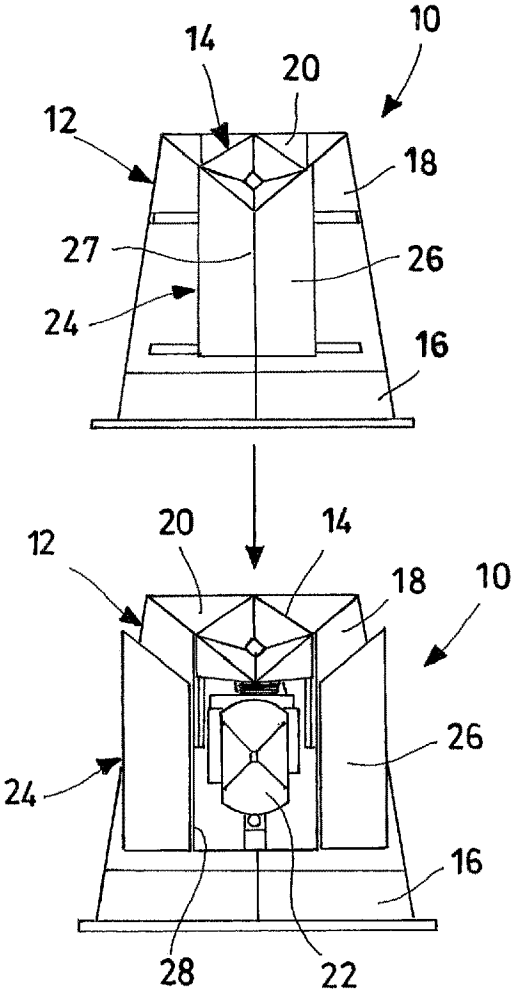
FIG. 3 is a view showing, form the top to the bottom, a transition of the turret shown in the previous figures between two different operating conditions, represented in a front elevation.
Figure 5:
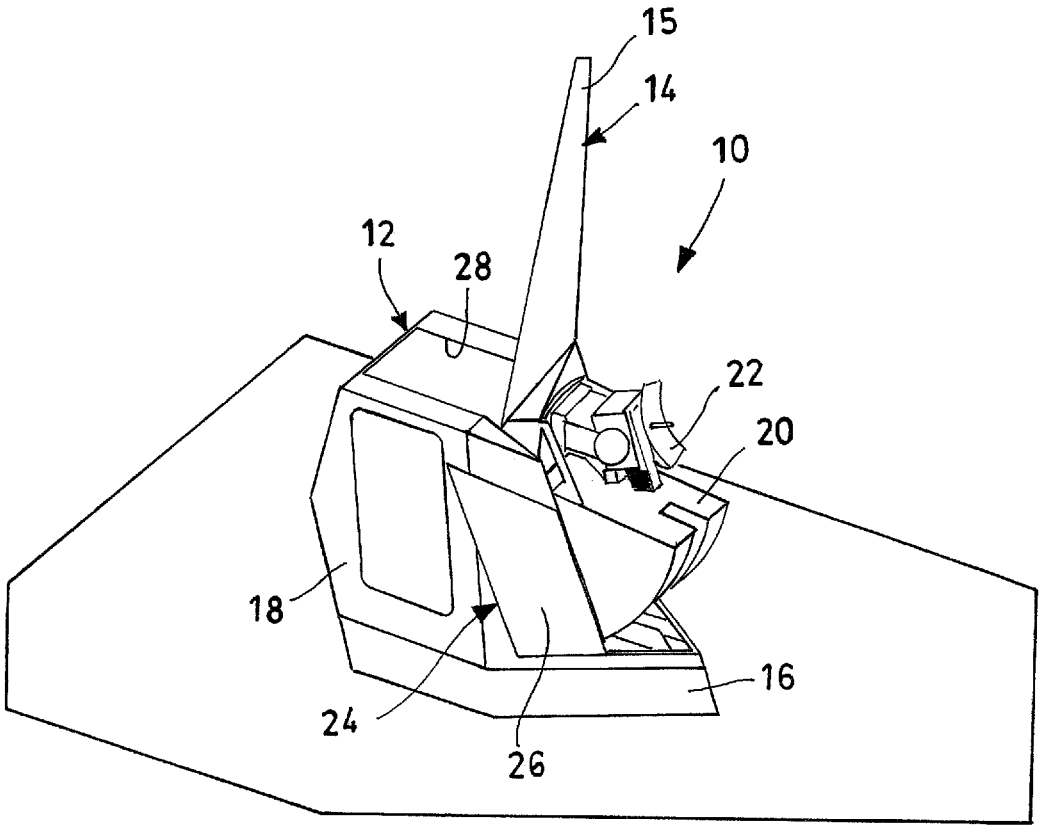
FIG. 5 is a top perspective view of the turret shown in FIG. 4.

As you can see, in particular, in FIGS. 3, 4 and 5, the turret 19 further comprises a munition guiding device 22, which is configured to direct a precision-guided munition, which is shot by the firearm 14 towards a target, for example through the emission of a radio wave follower beam, for example a laser beam. In particular, the munition guiding device 22 can cooperate with an external radar device (not shown), which is configured to determine the position—and, optionally, the speed—of a stationary or moving target, such as an aircraft.

In particular the external radar device preferably is configured to detect data indicating the position of the target, such as the azimuthal angle, the height and the distance relative to a reference point. More preferably, the munition guiding device 22 is also configured to detect data indicating the speed of the target, thus providing a predictive estimation of the trajectory followed by the target.

In the embodiment shown herein, the munition guiding device 22 is configured to orient and emit the follower beam towards the target based on the indicating data detected by the external radar. By so doing, the munition shot through the barrel of the firearm 14 is capable of following the target through a built-in electronic system, which "follows" the follower beam.

The turret 10 further comprises a protection apparatus 24, which is mounted on the support assembly 12 and is configured to assume a covering condition (FIGS. 1 and 2), in which it hides the munition guiding device 22 on the inside of said support assembly 12, and an opening condition (FIGS. 4 and 5), in it shows the munition guiding device 22 on the outside of the support assembly 12.

By way of example, FIG. 3 shows the transition between the covering condition and the opening condition of the protection apparatus 24. More in detail, in the turret 10 shown in the top part of the figure, said protection apparatus 24 is in the covering condition. On the other hand, in the turret 10 shown in the top bottom of the figure, said protection apparatus 24 is in the opening condition.

The covering condition typically takes place when the turret 10 is not operating, namely when the firearm 14 is not used to shoot against a stationary or moving target. In this way, in case of a sudden attack carried out by an external source of threat, the munition guiding device 22 is hidden and remains completely "concealed" on the inside of the support structure 12 of the turret 10. Therefore, in this condition, thanks to the protection apparatus 24, the integrity of the munition guiding device 22 is preserved in case of impact with missiles, further reducing its traceability through radar.

Vice versa, the opening condition usually takes place when the turret 10 is operating, namely when the firearm 14 is used to shoot against a stationary or moving target. In this way, the munition guiding device 22 can be aimed at the space outside the turret 10 so as to allow it to detect the position and/or speed of a target to be hit with the firearm 14.

In the embodiment shown herein, the munition guiding device 22 is integral to the pivoting structure 20 in its rotation, so as to rotate with it in an integral manner about the elevation axis X. In particular, the firearm 14 and the munition guiding device 22 are rotary about the elevation axis X.

In the embodiment shown herein, the munition guiding device 22 is movable relative to the pivoting structure 20. For example, the munition guiding device 22 is supported by the pivoting structure 20 with a freedom of azimuthal rotation and/or zenithal elevation relative to the pivoting structure 20, so as to allow the beam to be oriented in the space in order to direct the munitions. Advantageously, the munition guiding device 22 is located under the barrel of the firearm 14. In the embodiment shown herein, the protection apparatus 24 is mounted on the swivelling structure 18 in a front portion, namely a position from which the firearm 14 and the munition guiding device 22 are destined to project. However, in alternative embodiments, the protection apparatus can also be mounted on the pivoting structure.

Preferably, the protection apparatus 24 comprises a shield located in a front part of the support assembly 12 (in the embodiment shown herein, it is located in the front part of the swivelling structure 18). As already mentioned above, the shield can be moved between the covering condition and the opening condition.

Advantageously, though not necessarily, the shield comprises a pair of doors 26, which are hinged on a front wall of the support assembly 12. In the embodiment shown herein, the pair of doors 26 are hinged to the swivelling structure 18. However, in further embodiments of the present invention, it is possible to create said shield by adopting only one of said doors or even by using shields of a different type (for example, with one or more doors that slide in a guided manner on the support structure 12).

In the embodiment shown herein, the movement of the shield between the covering condition, corresponding to a closed position of the doors 26, and the opening condition, corresponding to a completely open position of said doors 26, is of the type with leafs capable of pivoting outwards from the support structure 12.

Preferably, though not necessarily, in the covering condition the ends of the doors 26 rest against one another so as to form a front corner indicated with 27 in FIG. 3. Hence, when the doors 26 are in the covering condition, the protection apparatus 24 has, at the front, a corner-like profile, which helps "hide" the munition guiding device 22 with a "stealth" shape, thus reducing the radar track of the turret.

In particular, the swivelling structure 18 defines a central compartment 28 (better visible in FIG. 5), through which the pivoting structure 20—carrying the firearm 14 and the munition guiding device 22—is mounted with freedom of movement about the elevation axis X and supported by a proper carriage.

When the doors 26 are in the opening condition, the munition guiding device 22 faces outwards from the swivelling structure 18 through the central compartment 28. In particular, the doors 26 are hinged in the area of the edges that laterally delimit the central compartment 28. In the embodiment shown herein, the doors 26 are configured to pivot outwards from the swivelling structure 18, so as to open.

Preferably, the doors 26 are configured to pivot into the opening condition (completely open condition) about a substantially vertical hinging axis when the turret 10 is operatively mounted on a fixed part (by way of example, on the upper deck of a ship).

In the embodiment shown herein, the pivoting structure 20 is capable of assuming a storaging position, in which the munition guiding device 22 is completely contained in the shapes of the swivelling structure 18. In this storing position, the doors 26 of the protection apparatus 24 are capable of moving from the opening condition to the closing condition. In particular, the storing position assumed by the pivoting structure 20 corresponds to a substantially horizontal orientation of the firearm 14, namely an orientation in which the elevation of said firearm 14 is substantially equal to 0°. In the embodiment shown herein, when the pivoting structure 20 is angularly spaced apart from the storing position, the doors 26 would not be able to close, as they would strike against the device 22 or the rest of the pivoting structure 20, which would project beyond the shape defined by the swivelling structure 18.

In the embodiment shown herein, the doors 26 can be moved by an actuator apparatus, for example one or more electric motors.

By way of example, the doors 26 are made of a metal material (e.g. steel). Preferably, the turret 10 comprises a control system, which is configured to control the movement of the protection apparatus 24 (in particular the doors 26) between the covering condition and the opening condition, for example by means of the actuator apparatus mentioned above. The control system can, more preferably, have a manual operating mode to cause the movement of the doors 26, which turns out to be useful, in particular, in emergency condition or, anyway, any time the automatic operation cannot be used.

Furthermore, the above-mentioned control system is configured to control the movement of the swivelling structure 18 and the movement of the pivoting structure 20, independently of one another, so as to obtain the orientation of the firearm 14 according to the desired shooting line. In particular, the control system can be configured to automatically determine the desired shooting line and to control said movements accordingly, based on the position and/or speed data of a target acquired by the radar device and depending on the operation of the munition guiding device 22, according to predetermined criteria.

Hereinafter you can find a description of an explanatory operating mode of the turret 10.

Let's consider the movement from a rest configuration to an operating configuration of the turret 10, in which the firearm 14 is destined to be operated so as to shoot against a stationary o moving target.

During this movement, at first the doors 26 are moved from the covering condition to the opening condition. By so doing, the munition guiding device 22 is shown on the outside of the support structure 12, so that it can emit a radio wave follower beam towards the target, for example depending on the data concerning the position—and optionally the speed—assumed by a stationary or moving target, which is going to be shot at by means of the firearm 14. As already mentioned above, said data can be detected by an external radar device.

Furthermore, the movement of the protection apparatus from the covering condition to the opening condition preferably allows the pivoting structure 20 to rotate about the elevation axis X. As a matter of fact, in the embodiment shown herein, should the doors 26 be in the covering condition (closing position), the movement of the pivoting structure 20 would be hindered by doors 26 themselves, which would cover the opening 28.

After the protection apparatus 24 has moved to the opening condition, the control system causes, independently of one another:

the movement of the swivelling structure 18 relative to the base 16 about the azimuthal rotation or swivelling axis Y, and the movement of the pivoting structure 20 relative to the swivelling structure 18 about the zenithal rotation or elevation axis X.

These movements allow the firearm 14 to take on an orientation corresponding to a desired shooting line, so as to shoot a stationary or moving target.

The control of the two aforesaid movements through the control system can be carried out:

automatically by means of predetermined criteria and based on the orientation of the emission of the radio wave follower beam carried out by the munition guiding device 22 and/or on position and/or speed data detected by the radar device, and/or manually by a user through known interfaces.

Naturally, the principle of the invention being set forth, embodiments and implementation details can be widely changed relative to what described above and shown in the drawings as a mere way of non-limiting example, without in this way going beyond the scope of protection provided by the accompanying claims.

The invention claimed is:

1. A turret comprising:

a firearm configured for shooting precision-guided munitions;

a support assembly which supports said firearm and which is configured for moving said firearm about an azimuthal rotation or swivelling axis and about a zenithal rotation or elevation axis;

a protection apparatus mounted on said support assembly and configured to assume a covering condition and an opening condition; wherein in said opening condition, said protection apparatus exposes said munition guiding device on an outside of said support assembly;

a munition guiding device mounted on said support assembly and configured for directing a precision-guided munition, which is shot by said firearm towards a target;

wherein in said covering condition, said protection apparatus hides only said munition guiding device on an inside of said support assembly, and wherein the firearm is on the outside of the support assembly.

2. The turret according to claim 1, wherein said protection apparatus comprises a shield arranged in a front part of said support assembly and movable between said covering condition and said opening condition.

3. The turret according to claim 2, wherein said shield comprises at least one door hinged on a front wall of said support assembly.

4. The turret according to claim 3, wherein said at least one door pivots outwards from the support assembly, when said at least one door moves from said covering position to said opening condition.

5. The turret according to claim 1, wherein said support assembly comprises:

a base adapted to being fixed to a fixed part, a swivelling structure supported by said base and rotating about said swivelling axis, and a pivoting structure supported by said swivelling structure and rotating about said elevation axis and supporting said firearm.

6. The turret according to claim 5, wherein said munition guiding device is mounted on said pivoting structure under said firearm.

7. The turret according to claim 6, wherein said protection apparatus is mounted on said swivelling structure.

8. The turret according to claim 5, wherein said swivelling structure defines a central compartment, through which said pivoting structure is mounted with freedom of movement around said elevation axis.

9. The turret according to claim 8, wherein when said protection apparatus is in the opening condition, said munition guiding device faces outwards from said swivelling structure through said central compartment.

10. The turret according to claim 8, wherein said protection apparatus comprises at least one door, which is hinged in an area of an edge laterally delimiting said central compartment.

11. The turret according to claim 1, wherein the protection apparatus comprises a shield located in a front part of the support assembly; said shield comprising at least one door hinged on a front wall of the support assembly and configured to pivot into the opening condition about a substantially vertical hinging axis.

12. The turret according to claim 1, wherein said munition guiding device is configured to cooperate with an external radar device to determine a position of a stationary or moving target.

* * * * *